US006705707B2

(12) United States Patent
Furukawa

(10) Patent No.: US 6,705,707 B2
(45) Date of Patent: Mar. 16, 2004

(54) INK JET RECORDING METHOD AND DEVICE HAVING MENISCUS CONTROL

(75) Inventor: Koji Furukawa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 38 days.

(21) Appl. No.: 10/046,262

(22) Filed: Jan. 16, 2002

(65) Prior Publication Data

US 2002/0122099 A1 Sep. 5, 2002

(30) Foreign Application Priority Data

Jan. 16, 2001 (JP) ..... P.2001-007834
Feb. 1, 2001 (JP) ..... P.2001-025672

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,742,412 A * 4/1998 Minemoto et al.

FOREIGN PATENT DOCUMENTS

| | | |
|---|---|---|
| JP | 10-501490 | 2/1998 |
| JP | 11-192732 | 7/1999 |
| JP | 2000-63723 | 2/2000 |
| JP | 2000-127417 | 5/2000 |

* cited by examiner

*Primary Examiner*—Raquel Yvette Gordon
(74) *Attorney, Agent, or Firm*—Sughrue Mion, PLLC

(57) ABSTRACT

An ink jet recording method comprising discharging ink from a leading edge of a projection to form an image, in which (1) the ink is discharged by applying a voltage across electrodes based on an image data signal, and forming a meniscus around the leading edge of the projection in synchronism with the image signal, or (2) the ink is discharged by forming a meniscus around the leading edge of the projection based on an image data signal in an electrostatic field.

19 Claims, 10 Drawing Sheets

FIG. 5(a)-1
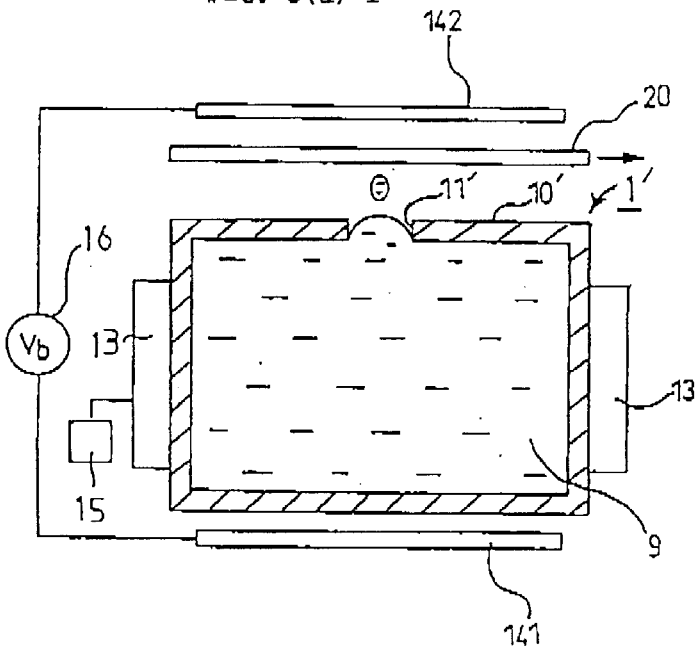
FIG. 5(a)-2
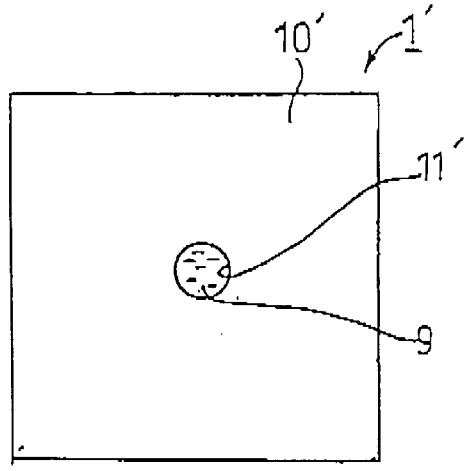
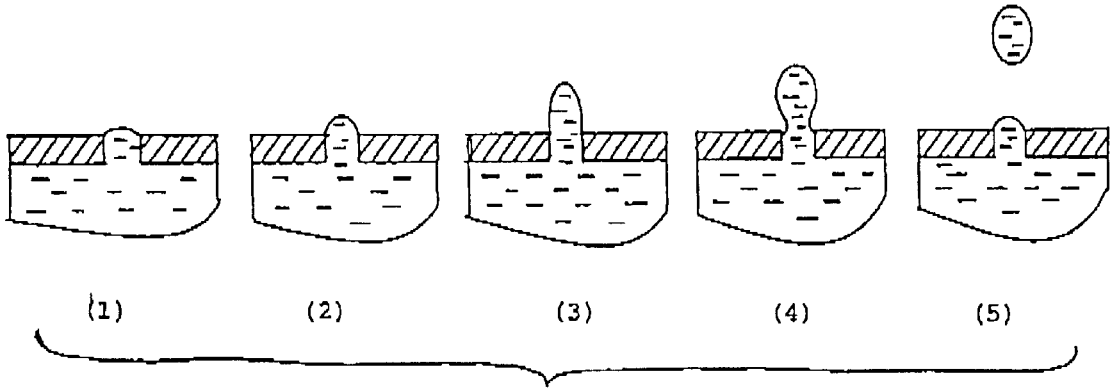
FIG. 5(b)

INK JET RECORDING METHOD AND DEVICE HAVING MENISCUS CONTROL

FIELD OF THE INVENTION

The present invention relates to an ink jet recording method and an ink jet recording device discharging ink by electrostatic force, and more particularly to an ink jet recording method and device controlling the formation of a meniscus around a leading edge of a projection when ink is discharged from the leading edge of the projection.

BACKGROUND OF THE INVENTION

In ink jet recording systems, processing such as a development stage is not required, and recording heads are small in size so that recording devices can be easily miniaturized. Accordingly, the ink jet recording systems have widely come in practice.

The conventional ink jet recording systems include a system using piezoelectric elements deformed depending on electric signals, a system using heating resistors generating heat depending on electric signals, and a system using electrostatic force according to electric signals.

All the above-mentioned ink jet recording systems have the problem that poor image drawing occurs by an increase in ink viscosity or solidification of ink caused by evaporation of solvent for ink from ink discharge portions Accordingly, ink jet recording devices are equipped with means for sealing ink discharge outlets when printing is not conducted, and means for cleaning the discharge outlets, if desired, With respect to such a problem, JP-A-11-192732 (the term "JP-A" as used herein means an "unexamined published Japanese patent application") discloses a method of discharging ink for every predetermined period from a recording head independently of image drawing for preventing clogging of ink, and JP-A-2000-127417 discloses a technique relating to a method for cleaning a discharge outlet. For solving such a problem, ink used in such ink jet recording systems contains an aqueous or organic solvent in a large amount, in which dye or pigment is contained as a coloring agent, and is low in viscosity and low in the concentration of the coloring agent.

In such ink jet recording systems, therefore, blurs of images occur so that it is difficult to form images of high image quality and high resolution. Further, the time is required for drying image formation areas so that it is difficult to improve the productivity.

On the other hand, for achieving an ink jet recording system giving reduced blurs of images, high drying speed, and high image quality and good productivity, Japanese Patent No. 3000672 and JP-A-2000-63723 disclose ink in which particles of coloring agent are dispersed in a solvent. For reducing the blurs of images and increasing the drying speed in the above-mentioned ink, it is effective to increase the coloring agent particle concentration and decrease the solvent concentration.

However, the application of the ink increased in the coloring agent particle concentration and decreased in the solvent concentration to the conventional ink jet recording systems results in clogging of the ink in a discharge portion. It is therefore difficult to draw good images. In particular, when minute droplets are discharged for obtaining images of high image quality and high resolution in the system using piezoelectric elements deformed depending on electric signals and the system using heating resistors generating heat depending on electric signals, it is necessary to decrease a nozzle diameter of the discharge portion, which is liable to cause clogging in the discharge portion.

Further, in the ink jet recording system in which ink is discharged by electrostatic force, a high-voltage pulse electric signal is necessary for discharging the ink increased in the coloring agent particle concentration and decreased in the solvent concentration. As a result, another problem arises that control units become extremely expensive.

On the other hand, as disclosed in International Patent Publication No. 501490/1998, a recording device is proposed in which ink in an ink discharge outlet of a recording head is kept in a state just before discharge, energy is given to the ink in the ink discharge outlet by an image signal through a meniscus formation unit (a unit for giving energy to ink such as a heater, an ultrasonic generator or a piezoelectric element) in response to an image signal, thereby destroying the balance of the ink which has been in a balanced state between electrostatic force and surface tension up to then to discharge an ink droplet from the ink discharge outlet, and the ink droplet is allowed to travel toward a recording medium while being accelerated by the electrostatic force to make a recording.

FIG. 5(*a*)-(1) is a schematic cross sectional view showing a recording device based on such a principle, and FIG. 5 (*a*)-(2) is a schematic plan view thereof. In the schematic plan view, a second bias electrode, an ink meniscus formation unit and an image receiving sheet are excluded for convenience' sake.

Referring to FIGS. 5(*a*)-(1) and 5(*a*)-(2), numeral 1' is a recording head, numeral 10' is an ink chamber, numeral 11' is a discharge outlet, numeral 13 is an ink meniscus formation unit, numeral 141 is a first bias electrode, and numeral 142 is a second bias electrode. Numeral 15 is a meniscus control unit for controlling the meniscus formation unit 13, numeral 16 is a discharge control unit for controlling an electric signal applied across the first bias electrode 141 and the second bias electrode 142, numeral 20 is an image receiving sheet fixed to an image receiving sheet fixing member (not shown) and moving in the direction indicated by the arrow, and numeral 9 is ink.

In the recording device, the discharge control unit 16 has previously applied a bias voltage Vb across the first bias electrode 141 and the second bias electrode 142. The bias voltage Vb is such a voltage that the ink in the ink discharge outlet 11' of the recording head 1' is not discharged.

Then, energy is given to the ink in the ink discharge outlet 11' by the meniscus formation unit 13 in response to an image signal, thereby destroying the balance of the ink which has been in a balanced state between electrostatic force and surface tension up to then to discharge an ink droplet from the ink discharge outlet 11'.

The discharged ink droplet is allowed to travel toward the image receiving sheet (recording medium) 20 while being accelerated by an electric field formed between the first bias electrode 141 and the second bias electrode 142 to make a record on the recording medium 20.

FIGS. 5(*b*)-1 to 5(*b*)-5 show the principle of printing operation as described above.

An electrically heated transducer is used as the meniscus formation unit, and the ink in the discharge outlet is heated thereby to elevate the temperature thereof at the meniscus, thus forming an ink droplet. When the temperature is elevated, the surface tension is lowered below the critical surface tension. As a result, the ink is discharged from the discharge outlet. The ink droplet discharged is accelerated in the direction of the bias electrode 142, and collides with the recording medium 20.

The radius of the discharge outlet used herein is 20 μm.

FIG. 5(*b*)-1 is a cross sectional view showing the discharge outlet at a standstill position, and the ink is pressurized by the bias voltage. As a result, the ink meniscus expands, and the expansion of the ink meniscus allows the electric field to slightly concentrate. Bonding force by the ink pressure and the electric field is in a state of equilibrium with the surface tension.

FIG. 5(*b*)-2 shows a nozzle just after an energy supply pulse has been supplied to the meniscus formation unit (electrically heated transducer) 13. Heat is transmitted to a surface of the ink, and the resulting increase in temperature causes a local decrease in the surface tension of the ink to somewhat develop the ink meniscus.

FIG. 5(*b*)-3 shows further development of the ink meniscus. The ink meniscus exhibits a substantially cylindrical form by a gradient of the surface tension from the discharge outlet to the center of the meniscus. In this stage, almost all movements of the ink are still caused by positive ink pressure. However, the electric field acting on the ink becomes strong enough to attract the ink from the nozzle.

FIG. 5(*b*)-4 shows development of the ink meniscus a little later after the electrically heated transducer has been turned off, The surface tension starts to increase, and the ink starts to return to the discharge outlet. The ink at a tip of the ink meniscus is still attracted in the direction of the recording medium so that the ink meniscus starts to be constricted.

FIG. 5(*b*)-5 shows the ink droplet after it has been separated from the ink itself. Although the ink droplet is partially polarized in the electric field, it still has some charges. Accordingly, the ink droplet is accelerated in the direction of the bias electrode to collide with the recording medium.

Thus, a simple constant-voltage power supply can be used for generating the electric field, and it is unnecessary to separate the electric field applied to the nozzle from an electric field applied to an adjacent nozzle. It is therefore possible to narrow the space between the nozzles.

However, the recording device is subjected to the restriction that the discharge outlet cannot be made very larger for forming the strong electric field in the vicinity of the discharge outlet. Further, for forming a minute dot, the radius of the discharge outlet used herein is 20 μm. Accordingly, the use of high-viscosity ink increased in the coloring agent particle concentration and decreased in the solvent concentration in the recording device having such a narrow discharge outlet results in clogging of the ink in the discharge outlet. It has been therefore impossible to use such high-concentration and high-viscosity ink. For achieving no appearance of ink blurs on the recording medium, rapid drying speed and recording of high image quality and good productivity, it is disadvantageous that such high-concentration and high-viscosity ink cannot be used.

SUMMARY OF THE INVENTION

Giving attention to the above-mentioned problem, the invention has been made.

It is therefore an object of the invention to provide an ink jet recording method which gives reduced blurs, high drying speed, and high image quality and good productivity.

Another object of the invention is to provide an ink jet recording device discharging ink by electrostatic force, which gives reduced blurs, high drying speed, and high image quality and productivity, and is inexpensive.

According to the invention, there are provided:

1. An ink jet recording method comprising discharging ink from a leading edge of a projection to form an image, in which (1) the ink is discharged by applying a voltage across electrodes based on an image data signal, and forming a meniscus around the leading edge of the projection in synchronism with the image data signal, or (2) the ink is discharged by forming a meniscus around the leading edge of the projection based on an image data signal in an electrostatic field;
2. An inkjet recording device discharging an ink droplet toward an image receiving sheet, which comprises an ink tank and a recording head communicating with the ink tank, wherein the recording head comprises an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first discharge electrode arranged in the vicinity of the projection, a second discharge electrode arranged on the back side of the image receiving sheet, a discharge control unit for controlling an electric signal applied across the first discharge electrode and the second discharge electrode, and a meniscus control unit for controlling the meniscus formation unit, wherein the discharge control unit controls the electric signal comprising a pulse voltage based on an image data signal and a bias voltage irrespective of the image data signal, and the meniscus control unit controls the meniscus formation unit in synchronism with the image data signal;
3. An ink jet recording device discharging an ink droplet toward an image receiving sheet, which comprises an ink tank and a recording head communicating with the ink tank, wherein the recording head comprises an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first discharge electrode arranged in the vicinity of the projection, a second discharge electrode arranged on the back side of the image receiving sheet, a discharge control unit for controlling an electric-signal applied across the first discharge electrode and the second discharge electrode, a meniscus control unit for controlling the meniscus formation unit, a charge unit for charging the image receiving sheet and a charge control unit for controlling a charge amount of the charge unit, wherein the discharge control unit controls a pulse voltage based on an image data signal, the charge control unit controls a charge amount on the image receiving sheet to an amount corresponding to a bias voltage irrespective of the image data signal, and the meniscus control unit controls the meniscus formation unit in synchronism with the image data signal;
4. An ink jet recording device discharging an ink droplet toward an image receiving sheet, which comprises an ink tank and a recording head communicating with the ink tank, wherein the recording head comprises an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first bias electrode arranged in the vicinity of the projection, a second bias electrode arranged on the back side of the image receiving sheet, a bias voltage control unit for controlling A bias voltage applied across the first bias electrode and the second bias electrode, and a meniscus control unit for controlling the meniscus formation unit, wherein the bias voltage control unit controls the bias voltage irrespective of an image data signal, and the meniscus control unit controls the meniscus formation unit based on the image data signal;

5. An ink jet recording device discharging an ink droplet toward an image receiving sheet, which comprises an ink tank and a recording head communicating with the ink tank, wherein the recording head comprises an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a meniscus control unit for controlling the meniscus formation unit, a charge unit for charging the image receiving sheet and a charge control unit for controlling a charge amount of the charge unit, wherein the charge control unit controls a charge amount on the image receiving sheet to an amount corresponding to a bias voltage irrespective of the image data signal, and the meniscus control unit controls the meniscus formation unit based on the image data signal;

6. The ink jet recording device described in any one of items 2 to 5, wherein the meniscus formation unit is any one of a piezoelectric element, a heating element and an ultrasonic generating element, or a combination of two or more thereof;

7. The ink jet recording device described in any one of items 2 to 6, wherein the projection has a dielectric constant of 3 or more;

8. The ink jet recording device described in any one of items 2 to 7, wherein the ink tank is communicated with the ink charter through a porous member;

9. The ink jet recording device described in any one of items 2 to 8, wherein the recording head further comprises a temperature detecting unit for detecting the temperature of the recording head, and a temperature control unit for heating and/or cooling the recording head in response to the temperature detected;

10. The ink jet recording device described in any one of items 2 to 8, which further comprises a first accelerative electrode provided in the vicinity of the recording head, and a second accelerative electrode provided on the back side of the image receiving sheet;

11. An recording head comprising an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first discharge electrode arranged in the vicinity of the projection, a discharge control unit for controlling an electric signal applied across a second discharge electrode provided on the back side of an image receiving sheet for receiving an ink droplet discharged and the first discharge electrode, and a meniscus control unit for controlling the meniscus formation unit, wherein the discharge control unit controls the electric signal comprising a pulse voltage based on an image data signal and a bias voltage irrespective of the image data signal, and the meniscus control unit controls the meniscus formation unit in synchronism with the image data signal;

12. A recording head comprising an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first discharge electrode arranged in the vicinity of the projection, a discharge control unit for controlling an electric signal applied across a second discharge electrode provided on the back side of an image receiving sheet for receiving an ink droplet discharged and the first discharge electrode, and a meniscus control unit for controlling the meniscus formation unit, a charge unit for charging the image receiving sheet and a charge control unit for controlling a charge amount of the charge unit, wherein the discharge control unit controls a pulse voltage based on an image data signal, the charge control unit controls a charge amount on the image receiving sheet to an amount corresponding to a bias voltage irrespective of the image data signal, and the meniscus control unit controls the meniscus formation unit in synchronism with the image data signal;

13. An recording head comprising an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first bias electrode arranged in the vicinity of the projection, a bias voltage control unit for controlling a bias voltage applied across a second bias electrode provided on the back side of an image receiving sheet for receiving an ink droplet discharged and the first bias electrode, and a meniscus control unit for controlling the meniscus formation unit, wherein the bias voltage control unit controls the bias voltage irrespective of an image data signal, and the meniscus control unit controls the meniscus formation unit based on the image data signal;

14. A recording head comprising an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a meniscus control unit for controlling the meniscus formation unit, a charge unit for charging the image receiving sheet and a charge control unit for controlling a charge amount of the charge unit, wherein the charge control unit controls a charge amount on the image receiving sheet to an amount corresponding to a bias voltage irrespective of the image data signal, and the meniscus control unit controls the meniscus formation unit based on the image data signal.

In the ink jet recording method of the invention, the ink is basically discharged from the leading edge of the projection to form the image, and 1) the ink is discharged by applying the voltage across the electrodes based on the image data signal, and forming a meniscus around the leading edge of the projection in synchronism with the image data signal (hereinafter referred to as aspect A), or 2) the ink is discharged by forming the meniscus around the leading edge of the projection based on the image data signal in the electrostatic field (hereinafter referred to as aspect B).

The electrostatic field in aspect B is formed in the extent sufficient for providing an electric field at the leading edge of the projection so that discharge of ink may occur upon the formation of ink meniscus around the leading edge of the projection. The electric field at the leading edge of the projection does not act to discharge the ink when the leading edge of the projection protrudes beyond the ink surface. The electrostatic field strength may be appropriately determined taking the shape and material of the projection into consideration.

According to aspect A of the invention, the ink jet recording device is provided with the ink chamber, the projection disposed at the approximately center portion in the ink chamber so that the leading edge thereof points toward the discharge outlets the first discharge electrode arranged in the vicinity of the projection, and the second discharge electrode arranged on the back side of the image receiving sheet for receiving the ink droplet discharged, the pulse voltage based on the image data signal and the bias voltage irrespective of the image data signal are applied across the discharge electrodes, or the pulse voltage based on the image data signal is applied across the discharge electrodes while the image receiving sheet is charged in an amount corresponding to the bias voltage irrespective of the image data signal, the ink meniscus is formed around the leading edge of the projection in synchronism with the image data signal, thereby discharging the ink. Accordingly, even when the bias voltage or the charge amount is increased, undesirable ink discharge does not occur. The pulse voltage can therefore be decreased. Further, since the ink is discharged from the leading edge of the projection, minute droplets can be discharged even when the discharge outlet is increased in size.

Furthermore, even the application of high-concentration and high-viscosity ink causes no clogging of the ink in the discharge outlet, because of the discharge outlet increased in size. Accordingly, it becomes possible to provide the ink jet recording device giving reduced blurs, high drying speed, high image quality and good productivity, at low cost.

The bias voltage in aspect A is applied in an amount sufficient for providing an electric field at the leading edge of the projection so that discharge of ink may not occur even when the ink meniscus is formed around the leading edge of the projection. The discharge of ink does not occurs until the electric field strength at the leading edge of the projection reaches to an amount capable of discharging the ink by means of the application of the pulse voltage.

According to aspect B of the invention, the bias voltage irrespective of the image data signal has been applied across the bias electrodes or the charge corresponding to the bias voltage irrespective of the image data signal has been provided on the image receiving sheet, and the meniscus formation unit forms the meniscus around the leading edge of the projection by the image signal, thereby discharging the ink. Accordingly, even when the bias voltage or the charge amount is increased, undesirable ink discharge does not occur. Further, since the ink is discharged from the leading edge of the projection, minute droplets can be discharged, even when the discharge outlet is increased in size.

Furthermore, even the application of high-concentration and high-viscosity ink causes no clogging of the ink in the discharge outlet, because of the discharge outlet increased in size. Accordingly, it becomes possible to provide the ink jet recording device giving reduced blurs, high drying speed, high image quality and good productivity, at low cost.

In aspect B, the bias voltage is applied in an amount sufficient for providing an electric field at the leading edge of the projection so that discharge of ink may occur upon the formation of ink meniscus around the leading edge of the projection. The electric field strength at the leading edge is sufficient for discharging the ink, but the discharge of ink does not occur until the meniscus is formed around the leading edge of the projection.

BRIEF DESCRIPTION OF THE DRAWINGS

FIG. 2(1) shows a state in which a bias voltage is applied and a meniscus formation unit does not operate, FIG. 2(2) shows a state in which the meniscus formation unit operates, FIG. 2(3) shows a state in which the meniscus formation unit operates, and the bias voltage is further applied, and FIG. 2(4) shows a state in which the meniscus formation unit operates, and a pulse voltage in synchronism with an image signal is applied.

FIGS. 4(*a*)-1 and 4(*a*)-2 show a recording device of aspect B of the invention. FIGS. 4(*b*)-1 and 4(*b*)-2 show a conventional electrostatic attraction type recording device.

FIG. 5(*a*)-1 is a schematic cross sectional view showing a known recording device, and FIG. 5(*a*)-2 is a schematic plan view thereof. FIGS. 5(*b*)-1 to 5(*b*)-5 are views for illustrating the principle of printing operation.

DETAILED DESCRIPTION OF THE INVENTION

Embodiments of aspect A of the invention will be described in detail bellow.

Figures 1, 4A:
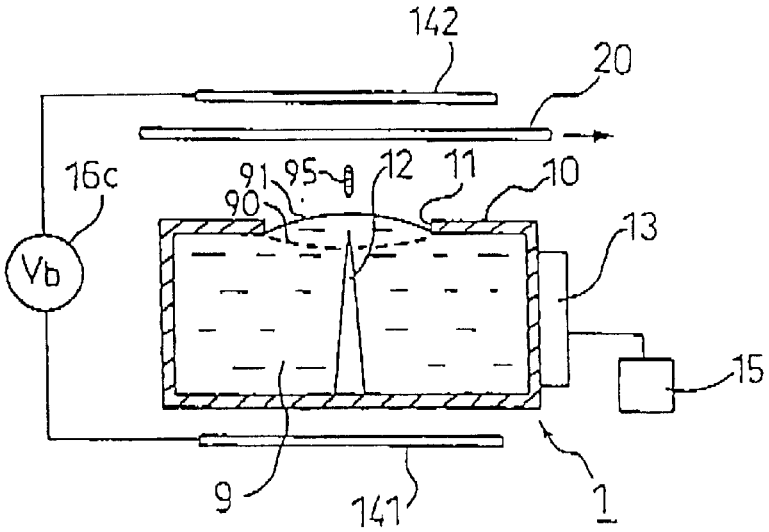
Figures 2, 4A:
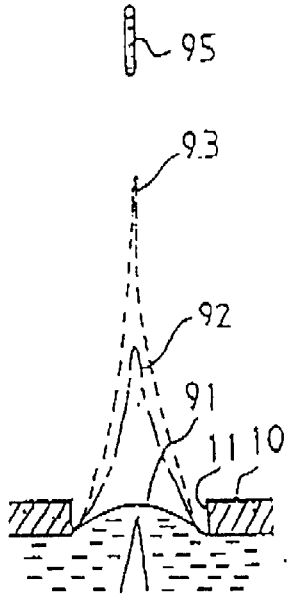
Figures 1, 4B:
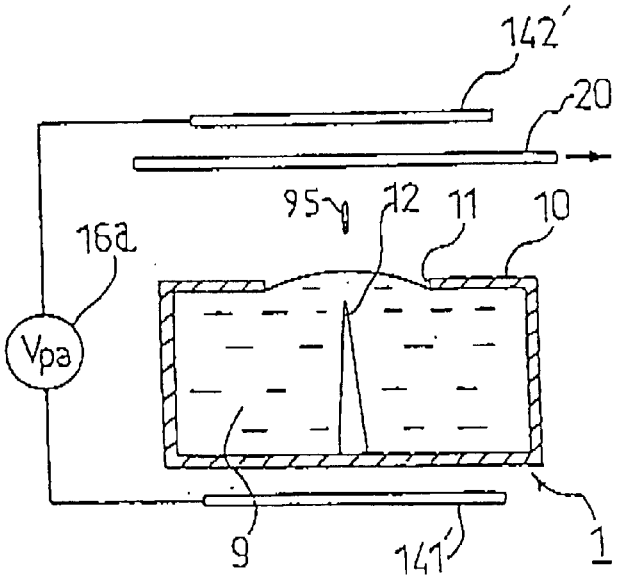
Figures 2, 4B:
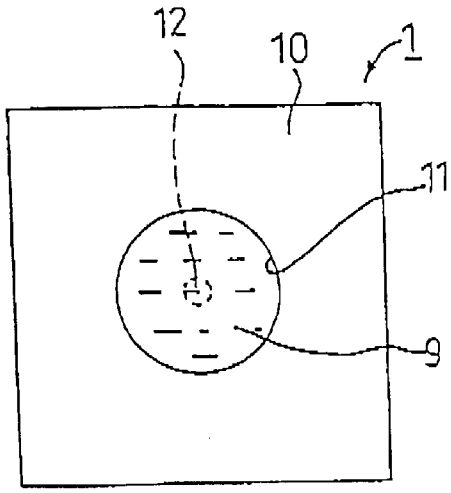

FIG. 1(*a*) is a schematic cross sectional view showing a first embodiment of aspect A of the invention, and FIG. 1(*b*) is a schematic plan view thereof.

In the schematic plan view, a discharge electrode and an image receiving sheet are excluded for convenience' sake.

Referring to FIGS. 1(*a*) and 1(*b*), numeral 1 is a recording head, numeral 10 is an ink chamber, numeral 11 is a discharge outlet, numeral 12 is a projection, numeral 13 is an ink meniscus formation unit, numeral 141 is a discharge electrode a, and numeral 142 is a discharge electrode b. Numeral 15 is a meniscus control unit for controlling the meniscus formation unit 13, numeral 16 is a discharge control unit for controlling an electric signal applied across the discharge electrodes a and b, numeral 20 is an image receiving sheet, and numeral 9 is ink.

According to the first embodiment of aspect A of the invention, the ink chamber 10 in the recording head 1 communicating with an ink tank (not shown) is provided with the discharge outlet lit and the projection 12 is disposed at an approximately center portion in the ink chamber 10 so that a leading edge thereof points toward the discharge outlet 11.

With respect to the structure of the projection 12, it is more preferred that the leading edge is pointed as shown in the drawing, because the electric field is concentrated at the leading edge. The material for the projection is preferably a material having a high dielectric constant such as ceramics. The dielectric constant is preferably 3 or more, and more preferably 10 or more.

It is preferred that the ink tank communicates with the ink chamber in the recording head through a porous member (not shown), because the effect of the operation by the meniscus formation unit is significantly improved.

Further, it is also preferred that a temperature control unit for detecting the temperature of the recording head 1 and for heating and/or cooling the recording head is provided.

The discharge electrode a (141) is arranged in the vicinity of the projection, and the discharge electrode b (142) is arranged on the back side of the image receiving sheet for receiving an ink droplet discharged. The ink tank 10 has the meniscus formation unit 13 for forming an ink meniscus around the leading edge of the projection 12. In FIG. 1(*a*), the meniscus formation unit 13 is provided outside the ink chamber 10. However, the meniscus formation unit 13 may be provided inside the ink chamber 10 depending on the kind thereof. Further, although the discharge electrode a (141) is also disposed outside the ink chamber 10 in FIG. 1(*a*), it may be disposed inside the ink chamber as long as it is in the vicinity of the projection.

The electric signal comprising a pulse voltage based on an image data signal and a bias voltage irrespective of the image data signal is applied across the discharge electrode a (141) and the discharge electrode b (142), and the applied voltage is controlled with the discharge control unit 16 for controlling the electric signal. The meniscus control unit 15 for controlling the meniscus formation unit 13 in synchronism with the image data signal is connected to the meniscus formation unit 13.

As the meniscus formation unit 13, there can be used a piezoelectric element and/or a heating element and/or an ultrasonic generating element.

In conducting image recording, ink droplets are discharged while making relative, movements of the image receiving sheet 20 and the recording head 1 by means of a carrier unit (not shown) for the image sheet and/or the recording head, thereby forming a two-dimensional image.

The ink 9 used may be any ink, as long as the liquid resistance of the ink itself is low. For example, ink comprising a solvent having low liquid resistance colored with a dye or the like, or ink comprising particles including pigment dispersed in a solvent having low liquid resistance can be used. The liquid resistance of the ink itself is preferably $10^{13}$ Ω.cm or less, and more preferably $10^{12}$ Ω.cm or less.

Ink having a high concentration of dispersed particles is preferred in that blur of image hardly occur. The particle concentration of ink is preferably 10% by weight or more, and more preferably 20% by weight or more.

Figure 1A:
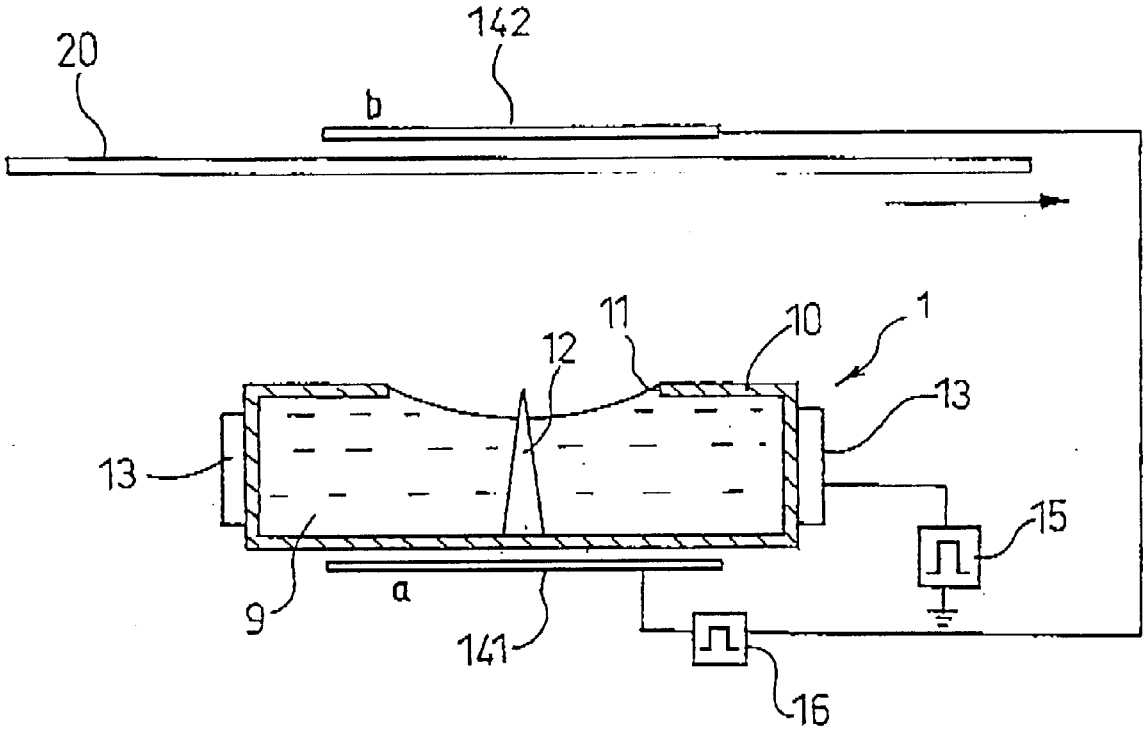
FIG. 1(*a*) is a schematic cross sectional view showing a first embodiment of aspect A of the invention, and FIG. 1(*b*) is a schematic plan view thereof.
Figure 1B:
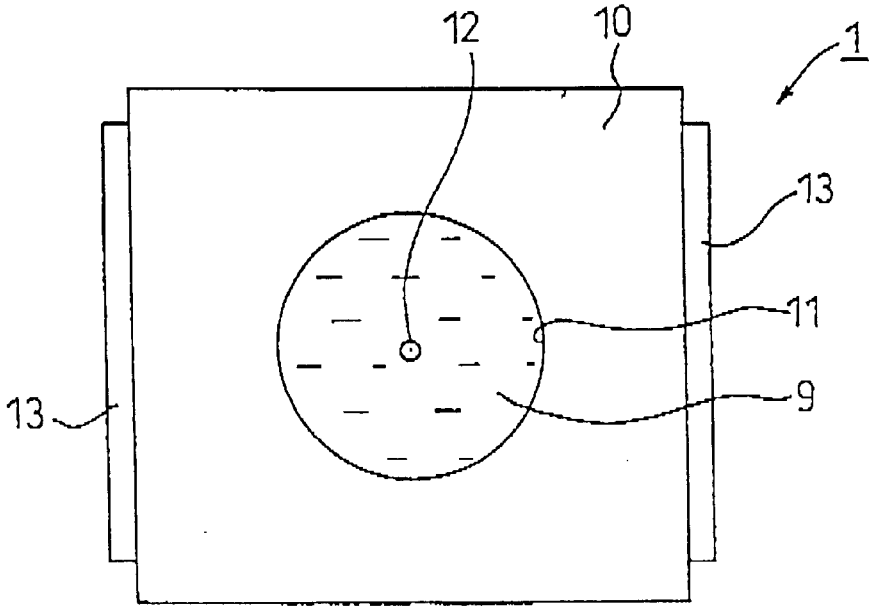
Figure 2:
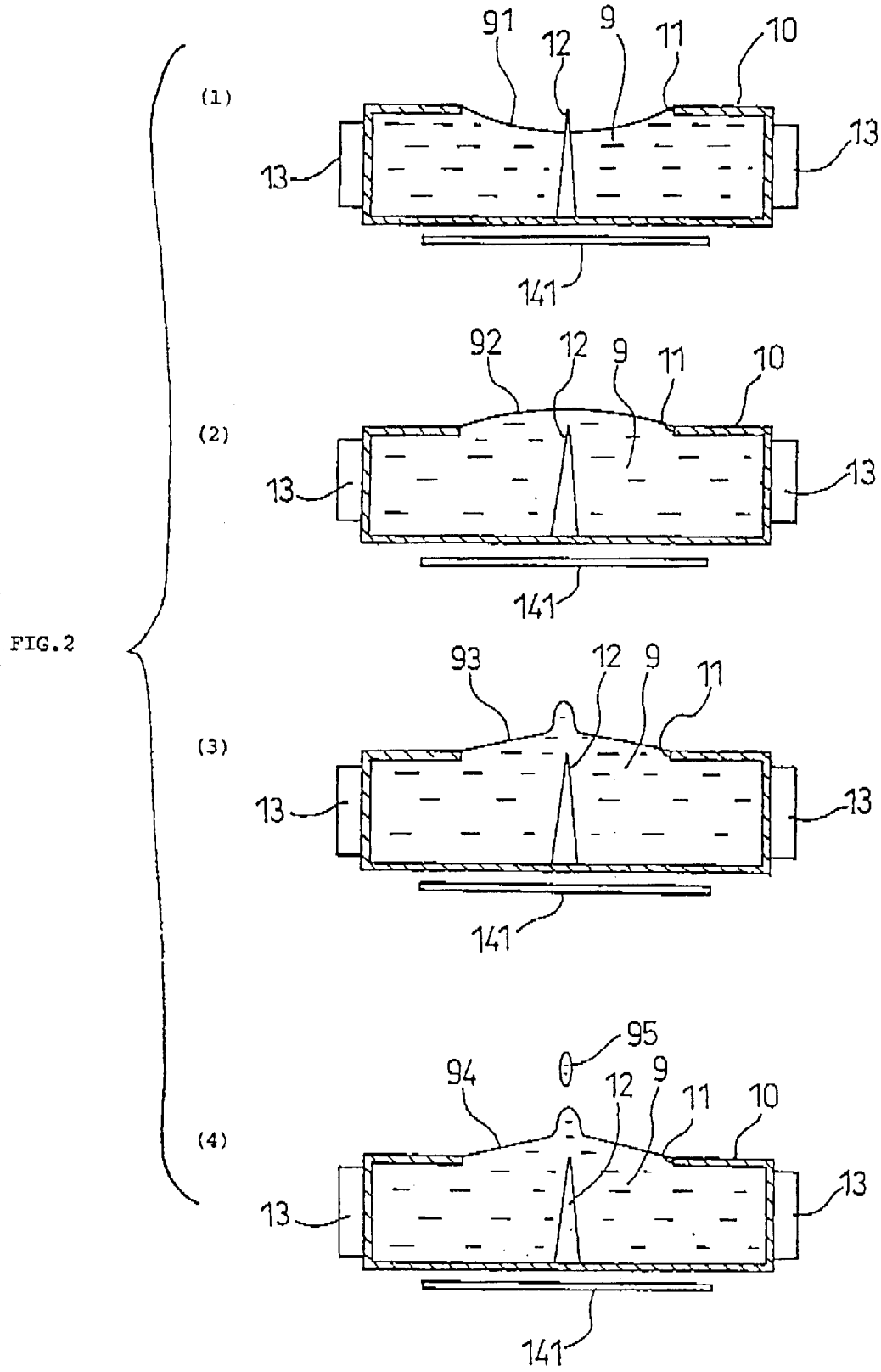
FIGS. 2(1) to 2(4) are views for illustrating the operation of discharging an ink droplet by means of the ink jet recording device shown in FIG. 1.

Now, using FIGS. 2(1) to 2(4), the operation of discharging an ink droplet in the first embodiment of aspect A is described in detail below. Referring to FIGS. 2(1) to 2(4), numeral 1 is a recording head, numeral 10 is an ink chamber, numeral 11 is a discharge outlet, numeral 12 is a projection, numeral 13 is an ink meniscus formation unit, numeral 141 is a discharge electrode a, and numeral 142 is a discharge electrode b. Numeral 15 is a meniscus control unit, numeral 16 is a discharge control unit for controlling an electric signal applied across the discharge electrodes a and b, numeral 9 is ink, numerals 91 to 94 are each an ink surface, and numeral 95 is an ink droplet discharged.

When no ink droplet is discharged, the meniscus formation unit 13 is not operated as shown in FIG. 2(1). Accordingly, ink meniscus is not formed around a leading edge of the projection 12. At that time, a bias voltage irrespective of an image signal is applied from the discharge control unit (16 in FIG. 1(*a*)) across the discharge electrode a (141) and the discharge electrode b (142). A strong electric field is formed around the leading edge of the projection 12 by the bias voltage. Even when the applied voltage of the bias voltage is established relatively high, undesirable ink discharge does not occur, since no ink meniscus is formed around the leading edge of the projection 12 (see the ink surface 91).

In case of discharging the ink droplet, the meniscus formation unit 13 is driven by a signal in synchronism with an image signal from the meniscus control unit 15, and the ink 9 in the ink chamber 10 protrudes from the discharge outlet 11 as numeral 92 of FIG. 2(2) to form the ink meniscus on a tip of the projection 12.

The smaller opening diameter of the discharge outlet 11 is better from the viewpoint of meniscus formation, and the opening diameter may be appropriately determined depending on the ink 9 used and the ability of the meniscus formation unit 13. However, for inhibiting clogging, it is preferred that the opening diameter of the discharge outlet 11 is as large as possible within the meniscus formable range.

According to the invention, the electric field can be concentrated at the leading edge of the projection 12 so that a considerably large opening diameter can form an ink meniscus. When the ink meniscus is formed, the electric field formed at the leading edge of the projection 12 by the bias voltage attracts the ink to pull it as shown by numeral 93 of FIG. 2(3). However, the ink is not discharged yet.

When the pulse signal in synchronism with the image signal is applied from the discharge control unit (16 in FIG. 1(*a*)) across the discharge electrode a (141) and the discharge electrode b (142), the ink droplet 95 is discharged from the ink surface 94 as shown in FIG. 2(4).

It is also possible to control the amount of the ink droplet 95 discharged by the pulse width of the pulse voltage.

As described above, the electric field can be concentrated at the leading edge of the projection 12 so that the opening of the discharge outlet can be considerably increased in size. Further, since the ink is discharged from the leading edge of the projection, even the use of ink having a high particle concentration compared with ink for use in conventional ink jet recording devices results in no clogging of the ink, and allows to discharge a minute ink droplet.

Since the ink having a high particle concentration and a low solvent concentration is used, blur of image hardly occur. Further, images of high quality can be obtained because of rapid drying speed.

A second embodiment of aspect A of the invention will he described with reference FIG. 3.

Figure 3:
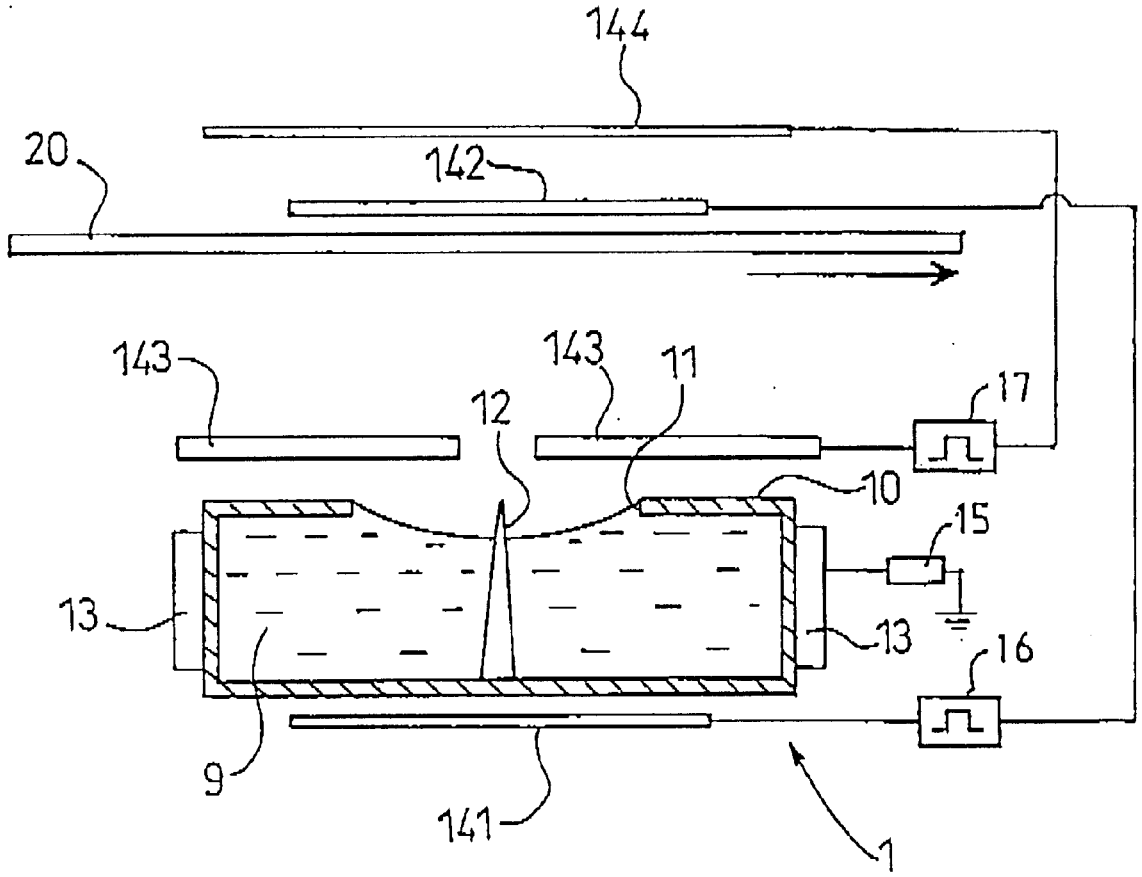
FIG. 3 is a schematic cross sectional view showing a second embodiment of aspect A of the invention.

Referring to FIG. 3, similar to FIG. 1(*a*), numeral 1 is a recording head, numeral 10 is an ink chamber, numeral 11 is a discharge outlet, numeral 12 is a projection, numeral 13 is an ink meniscus formation unit, numeral 141 is a discharge electrode a, and numeral 142 is a discharge electrode b. Numeral 15 is a meniscus control unit, numeral 16 is a discharge control unit for controlling an electric signal applied across the discharge electrodes a and b, and numeral 9 is ink. The second embodiment of aspect A is different from the first embodiment in that accelerative electrodes 143 and 144 are each disposed in the vicinity of the discharge outlet 11 and on the back side of an image receiving sheet 20 for receiving an ink droplet discharged, respectively, and an acceleration control unit 17 for controlling an electric signal applied across these accelerative electrodes 143 and 144 is provided. In FIG. 3, the accelerative electrode 144 disposed on the back side of the image receiving sheet is arranged separately from the discharge electrode b (142). However, it is also possible to use them as an integral body.

The process up to the discharge of the ink droplet from the discharge outlet 11 is same as in the first embodiment, and the second embodiment has a feature of controlling the ink droplet after the discharge.

A voltage is applied across the accelerative electrodes 143 and 144 by the acceleration control unit 17 in the direction accelerating the ink droplet (95 of FIG. 2(4)). The ink droplet discharged is accelerated by an electric field formed between the accelerative electrodes 143 and 144, and accurately impacted on the image receiving sheet 20.

As described above, compared with conventional ink jet recording devices, good impact accuracy can be obtained by providing the accelerative electrodes 143 and 144, even when the space between the recording head 1 and the image receiving sheet 20 is increased.

A third embodiment of aspect A of the invention will be described with reference to FIGS. 7(*a*) and 7(*b*).

Figure 7A:
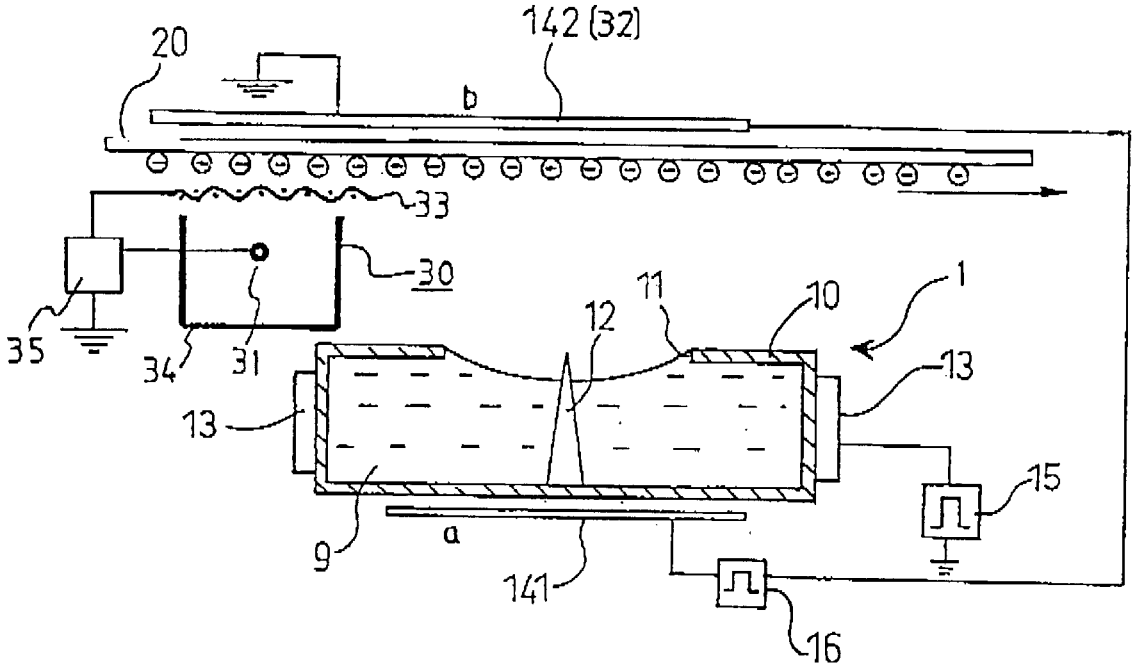
FIG. 7(*a*) is a schematic cross sectional view showing a third embodiment of aspect A of the invention, and FIG. 7(*b*) is a schematic plan view thereof.
Figure 7B:
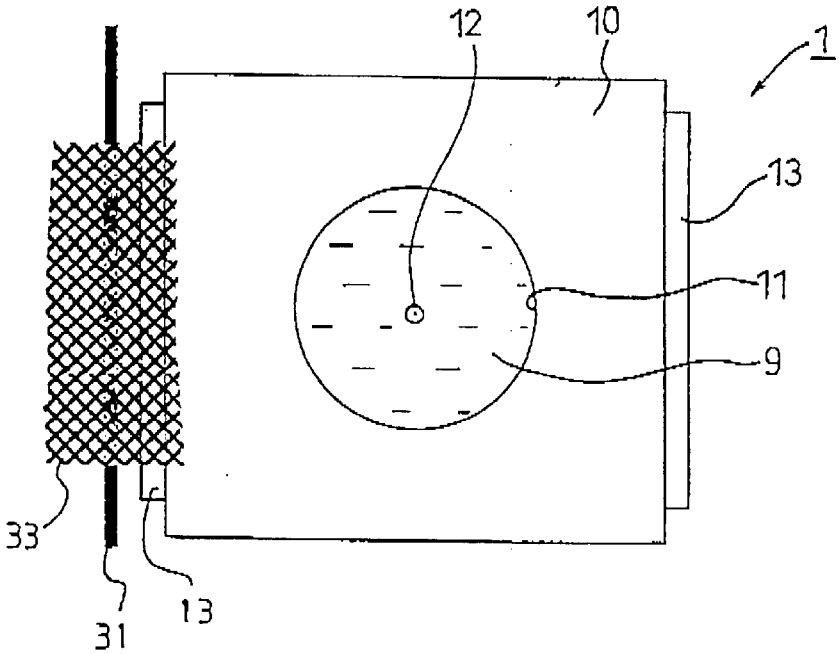

FIG. 7(*a*) is a schematic cross sectional view showing the third embodiment of aspect A of the invention, and FIG. 7(*b*) is a schematic plan view thereof. In the schematic plan view, a discharge electrode, an image receiving sheet, a charge control unit and a part of grid electrode are excluded for convenience' sake. Referring to FIGS. 7(*a*) and 7(*b*), similar to FIGS. 1(*a*) and 1(*b*), numeral 1 is a recording head, numeral 10 is an ink chamber, numeral 11 is a discharge outlet, numeral 12 is a projection, numeral 13 is an ink meniscus formation unit, numeral 141 is a discharge electrode a, and numeral 142 is a discharge electrode b. Numeral 15 is a meniscus control unit, numeral 16 is a discharge control unit for controlling an electric signal applied across the discharge electrodes a and b, and numeral 9 is ink. The third embodiment of aspect A is different from the first embodiment in that a charge unit for charging the image receiving sheet 20 and a charge control unit for controlling the charge unit are provided. Numeral 30 is the charge unit, numeral 31 is a corona wire (first electrode), numeral 32 is a second electrode and numeral 33 is the grid electrode, which is provided, for example, in the form of mesh as shown in the plan view of FIG. 7(*b*). Numeral 34 is a case and numeral 35 is the charge control unit.

A scorotron corona charger that can provide uniform and stable charge is used as the charge unit 30. The scorotron corona charger 30 is a non-contact type charge device wherein a high voltage (e.g., about −6 kV) is applied to a thin corona wire (first electrode) 31 to generate corona discharge across the first electrode 31 and the second electrode 32, and the image receiving sheet 20 is exposed to the corona discharge emitted from the opening of the case 34 to charge. The grid electrode 33 is disposed between the corona wire 31 and the second electrode 32. The grid electrode 33 and the corona wire 31 are connected to the charge control unit 35, respectively.

The charge control unit 35 can independently control the voltage applied to the corona wire 31 and the voltage applied to the grid electrode 33, and selects each value of the voltages so that a charge amount is controlled so as to charge the image receiving sheet 20 in an amount corresponding to a bias voltage irrespective of the image data signal. Specifically, while the discharge control unit 16 controls the electric signal comprising (1) a pulse voltage based on the image date signal and (2) the bias voltage irrespective of the image data signal in the first embodiment, in the third embodiment, the discharge control unit 16 only controls the pulse voltage (1) based on the image date signal, and with respect to the bias voltage irrespective of the image data signal, the charge control unit 35 controls so as to charge the image receiving sheet 20 in an amount corresponding to the bias voltage irrespective of the image data signal.

When no ink droplet is discharged, the meniscus formation unit 13 is not operated. Accordingly, ink meniscus is not formed around a leading edge of the projection 12. At that time, since the image receiving sheet 20 is charged in an amount corresponding to the bias voltage irrespective of the image signal under control by means of the charge control unit 35, a strong electric field is formed around the leading edge of the projection 12 due to the charge. However, the strong electric field does not act to discharge the ink, because the leading edge of the projection protrudes outside the ink surface illustrated as shown in FIG. 7(*a*). Even when the amount of the charge is relatively high, undesirable ink discharge does not occur, since no ink meniscus is formed around the leading edge of the projection 12.

In case of discharging the ink droplet, the meniscus formation unit 13 is driven by a signal in synchronism with an image signal from the meniscus control unit 15, and the ink 9 in the ink chamber 10 protrudes from the discharge outlet 11 as numeral 92 of FIG. 2(2) to form the ink meniscus on the leading edge of the projection 12.

The smaller opening diameter of the discharge outlet 11 is better from the viewpoint of meniscus formation, and the opening diameter may be appropriately determined depending on the ink 9 used and the ability of the meniscus formation unit 13. However, for inhibiting clogging, it is preferred that the opening diameter of the discharge outlet 11 is as large as possible within the meniscus formable range.

According to the invention, the electric field can be concentrated at the leading edge of the projection 12 so that a considerably large opening diameter can form an ink meniscus.

When the ink meniscus is formed, the electric field formed at the leading edge of the projection 12 with the charge on the image receiving sheet 20 attracts the ink to pull it as shown by numeral 93 of FIG. 2(3). However, the ink is not discharged yet.

When the pulse signal in synchronism with the image signal is applied from the discharge control unit 16 across the discharge electrode a (141) and the discharge electrode b (142), the ink droplet 95 is discharged from the ink surface 94 as shown in FIG. 2(4).

It is also possible to control the amount of the ink droplet 95 discharged by the pulse width of the pulse voltage.

As described above, the electric field can be concentrated at the leading edge of the projection so that the opening of the discharge outlet can be considerably increased in size. Further, since the ink is discharged from the leading edge of the projection, even the use of ink having a high particle concentration compared with ink for use in conventional ink jet recording devices results in no clogging of the ink, and allows to discharge a minute ink droplet.

Since the ink having a high particle concentration and a low solvent concentration can be used without the occurrence of clogging in the discharge outlet, blur of image hardly occur. Further, images of high quality can be obtained because of rapid drying speed.

According to the third embodiment of aspect A, it is not necessary to apply the bias voltage irrespective of the image data signal across the ejection electrodes a and b. Thus, a level of the control signal from the discharge control unit 16 is lowered and damage of the recording head 1 due to discharge from the recording head 1 is remarkably decreased.

In the third embodiment, the second electrode 32 of the scorotron corona charger 30 and the discharge electrode b 142 of the recording head 1 are unified to intend the reduction of materials and the miniaturization of device.

When resistance of the image receiving sheet 20 is low, it is preferred to dispose an insulating material between the image receiving sheet 20 and the second electrode 32. As the charge unit, any charger capable of controlling the charge amount including a corotron and a known solid charger, e.g., a roller charger may be preferably used in addition to the scorotron.

Although the charge unit 30 and the charge control unit 35 are arranged apart from the recording head 1 in the embodiment, they are positioned on the recording head 1 so that bases for attaching the units can be omitted and the device is made more compact.

Figure 8:
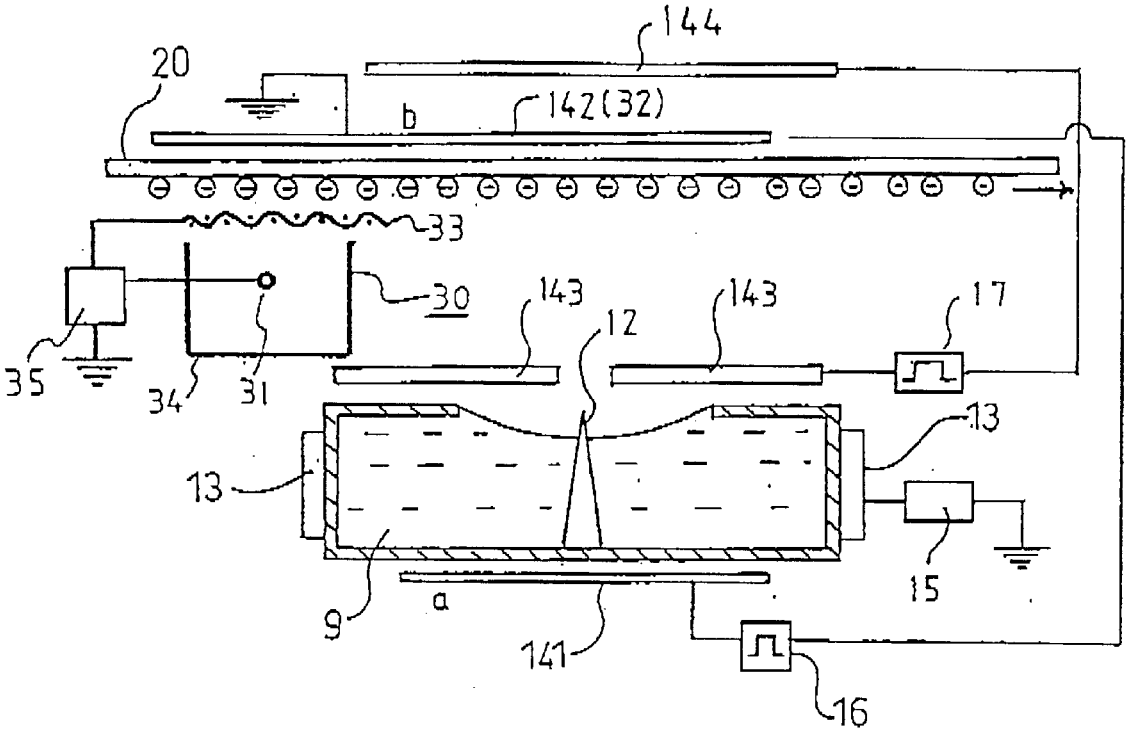
FIG. 8 is a schematic cross sectional view showing a fourth embodiment of aspect A of the invention.

To the recording device of FIG. 7(*a*), the second embodiment of the invention described above can also be applied. FIG. 8 shows a fourth embodiment of aspect A of the invention in which the recording device of FIG. 7(*a*) is equipped with accelerative electrodes 143 and 144. In FIG. 8, numeral 1 is a recording head, numeral 10 is an ink chamber, numeral 11 is a discharge outlet, numeral 12 is a projection, numeral 13 is an ink meniscus formation unit, numeral 141 is a discharge electrode a, and numeral 142 is a discharge electrode b. Numeral 15 is a meniscus control unit, numeral 16 is a discharge control unit for controlling an electric signal applied across the discharge electrodes a and b, and numeral 9 is ink. Numeral 30 is a charge unit, numeral 31 is a corona wire (first electrode), numeral 32 is a second electrode, numeral 33 is a grid electrode, numeral 34 is a case and numeral 35 is a charge control unit.

In FIG. 8, the accelerative electrode 144 disposed on the back side of the image receiving sheet is arranged separately from the discharge electrode b (142). However, it is also possible to use them as an integral body.

Since the process up to the discharge of the ink droplet from the discharge outlet 11 is same as in the third embodiment above, the description is omitted. The fourth embodiment has a feature of controlling the ink droplet after the discharge. The accelerative electrodes 143 and 144 are each disposed in the vicinity of the discharge outlet 11 and on the back side of the image receiving sheet 20 for receiving an ink droplet discharged, respectively, and a acceleration control unit 17 for controlling an electric signal applied across these accelerative electrodes 143 and 144 is provided.

A voltage is applied across the accelerative electrodes 143 and 144 by the acceleration control unit 17 in the direction accelerating the ink droplet. The link droplet discharged is accelerated by an electric field formed between the accelerative electrodes 143 and 144, and accurately impacted on the image receiving sheet 20.

As described above, compared with the ink jet recording device in the third embodiment described above, good impact accuracy can be obtained by providing the accelerative electrodes 143 and 144, even when the space between the recording head 1 and the image receiving sheet 20 is increased.

According to aspect A of the invention, in the ink jet recording method in which the ink is discharged by applying the voltage across the electrodes based on the image data signal, the meniscus is formed around the leading edge of the projection in synchronism with the signal applied across the electrodes. Accordingly, when no ink is discharged, an ink meniscus is not formed around the leading edge of the projection. Therefore, the bias voltage can be increased, and the pulse voltage at the time when the ink is discharged can be decreased, which makes it possible to prepare the control units in low cost.

Further, since the ink is discharged from the leading edge of the projection, minute droplets can be discharged, even when the discharge outlet is increased in size. Furthermore, since the discharge outlet increased in size is used, even the application of highly concentrated ink causes no clogging of the ink in the discharge outlet. It becomes therefore possible to provide the ink jet recording giving reduced blur, high drying speed, high image quality and good productivity.

Moreover, in case of using the charge of image recording sheet in place of the bias voltage, a load to the recording head can be decreased.

In addition, according to the embodiment wherein the accelerative electrodes are each disposed in the vicinity of the discharge outlet and on the back side of the image receiving sheet, respectively, and the signal is applied across these accelerative electrodes, the ink droplet discharged is accelerated by the electric field formed between the accelerative electrodes so that the ink droplet is accurately impacted on the image receiving sheet, which makes possible the ink jet recording of high image quality.

Embodiments of aspect B of the invention will be described in detail bellow.

FIGS. 4(*a*)-1 and 4(*a*)-2 show a recording device of aspect B of the invention, and FIGS. 4(*b*)-1 and 4(*b*)-2 show a conventional electrostatic attraction type recording device. FIG. 4(*b*)-1 is a schematic cross sectional view, and FIG. 4(*b*)-2 is a schematic plan view thereof. In the schematic plan view, a second discharge electrode and an image receiving sheet are excluded for convenience' sake.

Referring to FIGS. 4(*b*)-1 and 4(*b*)-2, numeral 1 is a recording head, numeral 10 is an ink chamber, numeral 11 is a discharge outlet, numeral 12 is a projection made of a high dielectric material, numeral 141' is a first discharge electrode, and numeral 142' is a second discharge electrode. Numeral 16*a* is a discharge control unit for controlling an electric signal applied across the first discharge electrode 141' and the second discharge electrode 142', numeral 20 is an image receiving sheet fixed to an image receiving sheet fixing member (not shown) and moving in the direction indicated by the arrow, and numeral 9 is ink.

In such a conventional recording device, the discharge control unit 1*a* applies a pulse voltage Vpa across the first discharge electrode 141' and the second discharge electrode 142' in response to the image signal, thereby concentrating an electric field at a leading edge of the projection 12 made of the high dielectric material to give electrostatic energy to the ink in the portion. An ink droplet is discharged from the ink discharge outlet 11, and the ink droplet discharged is allowed to travel toward the image receiving sheet (recording medium) 20 while being accelerated by the electric field formed between the first discharge electrode 141' and the second discharge electrode 142' to make a record on the recording medium 20.

As described above, the electric field can be concentrated at the leading edge of the projection 12 by the use of the projection 12. Accordingly, a diameter of the discharge outlet 11 can be sufficiently increased as shown in FIG. 4(*b*)-2 by arranging the leading edge of the projection 12 so that it is located in the ink in the vicinity of the discharge outlet 11.

Accordingly, even when ink sufficiently increased in a coloring agent particle concentration and decreased in a solvent concentration is used, clogging hardly occurs, and good image quality recording becomes possible in which blur of the ink is prevented on the recording medium.

However, according to the device, the pulse voltage Vpa bears all energy for discharging the ink droplet so that a high-voltage pulse is required. Accordingly, high-speed driving is difficult, and an expensive control unit is required.

The invention dissolves such a problem. According to aspect B of the invention, a leading edge of a projection is arranged in the vicinity of a discharge outlet to form a high electric field at the leading edge of the projection, and a diameter of the discharge outlet is increased sufficiently for using ink having a sufficiently high coloring agent particle concentration and a low solvent concentration. Moreover, a meniscus formation unit is provided, and an image signal is given thereto.

FIG. 4(*a*)-1 is a schematic cross sectional view showing a recording device according to aspect B of the invention. In FIG. 4(*a*)-1, numeral 1 is a recording head, numeral 10 is an ink chamber, numeral 11 is a discharge outlet, numeral 12 is a projection made of a high dielectric material, and numeral 13 is an ink meniscus formation unit, which may be any unit for giving energy to the ink, for example, a heater, an ultrasonic generator or a piezoelectric element. Numeral 141 is a first bias electrode, and numeral 142 is a second bias electrode. Numeral 15 is a meniscus control unit for controlling the meniscus formation unit 13, numeral 16*c* is a bias voltage control unit for controlling a bias voltage applied across the first bias electrode 141 and the second bias electrode 142, numeral 20 is an image receiving sheet fixed to an image receiving sheet fixing member (not shown) and moving in the direction indicated by the arrow, and numeral 9 is ink.

In such a recording device, the bias voltage control unit 16*c* applies a bias voltage Vb across the bias electrode 141 and the bias electrode 142, thereby forming a high electric field enough to discharge the ink at a leading edge of the projection 12. However, in a state in which the meniscus formation unit 13 is not operated, the leading edge of the projection protrudes beyond an ink surface as indicated by a dotted line 90, and no ink meniscus is formed. Accordingly, the ink is not discharged.

When the meniscus formation unit 13 gives energy to the ink in the ink chamber 10 of the recording head 1 by the meniscus formation unit 15 in response to the image signal, the ink surface protrudes as indicated by a solid line 91, and a state arises in which the leading edge of the projection 12 stays under the ink surface 91. As a result, an ink meniscus is formed around the leading edge of the projection 12 and attracted to the bias electrode 142 due to the high electric field formed, and finally discharged as an ink droplet 95 from the leading edge of the projection 12.

The ink droplet 95 discharged its allowed to travel toward the image receiving sheet (recording medium) 20 while being accelerated by the electric field formed between the bias electrode 141 and the bias electrode 142 to make a record on the recording medium 20.

FIG. 4(*a*)-2 is an enlarged cross sectional view showing changes in the ink surface until; the ink droplet 95 is discharged from the recording device according to aspect B of the invention. As shown in FIG. 4(*a*)-1, in the state in which the discharge control unit 16 applies the bias voltage Vb across the bias electrode 141 and the bias electrode 142 and the meniscus formation unit 13 is not operated, the ink surface is that indicated by the dotted line 90, and the leading edge of the projection 12 protrudes beyond the ink surface. While the high electric field is formed at the leading edge of the projection 12, the ink is not discharged because the leading edge protrudes beyond the ink surface.

When the meniscus formation unit 13 gives energy to the ink in the ink chamber 10 by the meniscus control unit 15, the ink surface protrudes as indicated by the solid line 91 to form the ink meniscus around the leading edge of the projection 12. At that time, the bias voltage Vb is applied across the bias electrode 141 and the bias electrode 142 so that the high electric field is formed at the leading edge of the projection. Consequently, the ink surface is attracted toward the bias electrode 142 from the state indicated by the solid line 91 via a state indicated by an alternate long and short dash line 92, to a state indicated by a dotted line 93, and finally discharged as the minute ink droplet 95. The ink droplet 95 thus discharged has a small size in comparison with an ink droplet discharged from a recording head without the projection as shown in FIG. 5(*b*) so that it is possible to conduct recording of high image quality.

As described above, according to aspect B of the invention, ink having a sufficiently high coloring agent particle concentration and a low solvent concentration can be used because of the wide discharge outlet. Moreover, coupled with the formation of the ink droplet small in size, the recording device enables to prevent the occurrence of ink blur on the recording medium, increase drying speed and perform recording of high image quality and good productivity.

Further, according to the device, an electric source used requires only the output voltage of the bias voltage so that cost reduction and miniaturization become possible.

With respect to the structure of the projection 12, it is more preferred that the leading edge is pointed as shown in the drawing, because the electric field is concentrated at the leading edge. The material for the projection is preferably a material having a high dielectric constant such as a ceramic. The dielectric constant is preferably 3 or more, and more preferably 10 or more.

It is preferred that the ink tank communicates with the ink chamber in the recording head through a porous member (not shown), because the effect of the operation by the meniscus formation unit is significantly improved.

Further, it is also preferred that a temperature control unit for detecting the temperature of the recording head 1 and for heating and/or cooling the recording head is provided.

The bias electrode 141 is arranged in the vicinity of the projection, and the bias electrode 142 is arranged on the back side of the image receiving sheet for receiving an ink droplet discharged. The ink tank 10 has the meniscus formation unit 13 for forming an ink meniscus around the leading edge of the projection 12. In FIG. 4(*a*)-1, the meniscus formation unit 13 is provided outside the ink chamber 10. However, the meniscus formation unit 13 may be provided inside the ink chamber 10 depending on the kind thereof. As the meniscus formation unit 13, there can be used a piezoelectric element and/or a heating element and/or an ultrasonic generating element.

Further, although the bias electrode 141 is also disposed outside the ink chamber 10 in FIG. 4(*a*)-1, it may be disposed inside the ink chamber as long as it is in the vicinity of the projection 12.

In conducting image recording, ink droplets are discharged while making relative movements of the image receiving sheet 20 and the recording head 1 by means of a carrier unit (not shown) for the image sheet and/or the recording head, thereby forming a two-dimensional image.

The ink 9 used may be any ink, as long as the liquid resistance of the ink itself is low. For example, ink comprising a solvent having low liquid resistance colored with a dye or the like, or ink comprising particles including pigment dispersed in a solvent having low liquid resistance can be used. The liquid resistance of the ink itself is preferably $10^{13}$ Ω.cm or less, and more preferably $10^{12}$ Ω.cm or less.

Ink having a high concentration of dispersed particles is preferred in that blur of image hardly occur. The particle concentration of ink is preferably 10% by weight or more, and more preferably 20% by weight or more.

Now, a second embodiment of aspect B of the invention is described with reference FIG. 6.

Figure 6:
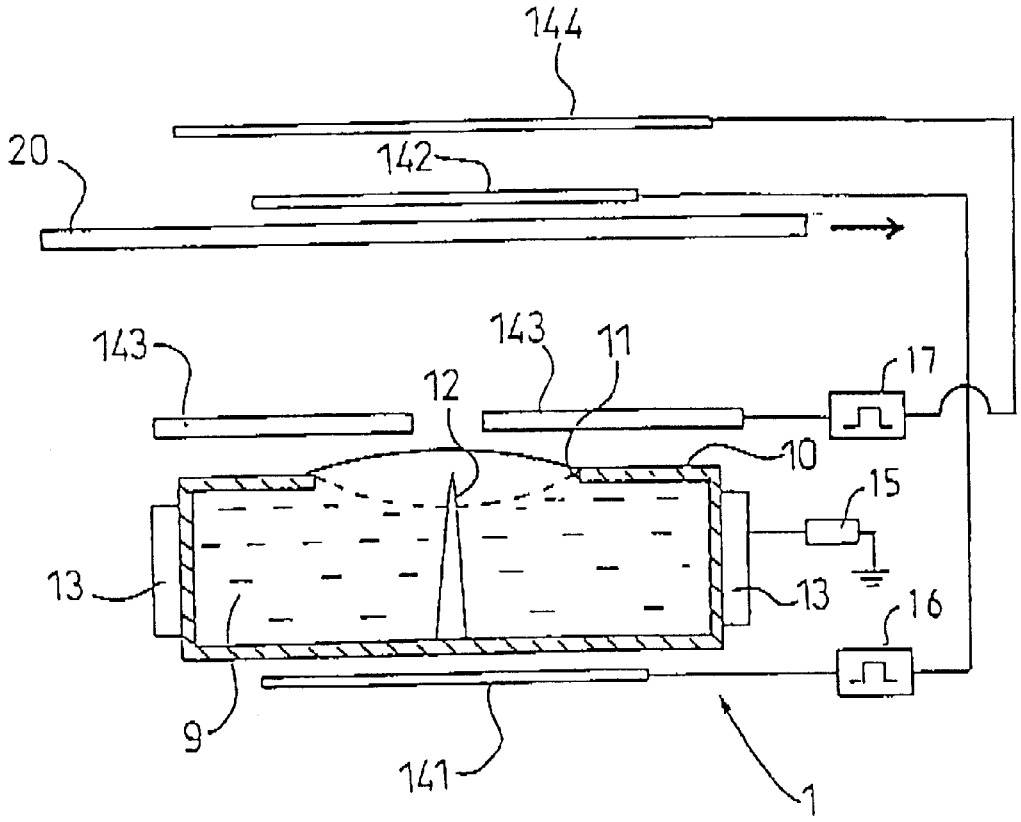
FIG. 6 is a schematic cross sectional view showing a second embodiment of aspect B of the invention.

Referring to FIG. 6, similar to FIG. 4(*a*)-1, numeral 1 is a recording head, numeral 10 is an ink chamber, numeral 11 is a discharge outlet, numeral 12 is a projection, numeral 13 is an ink meniscus formation unit, numeral 141 is a first bias electrode, and numeral 142 is a second bias electrode. Numeral 15 is a meniscus control unit, numeral 16 is a discharge control unit for controlling an electric signal applied across the first bias electrode and the second bias electrode, and numeral 9 is ink. The second embodiment of aspect B is different from the first embodiment in that accelerative electrodes 143 and 144 are each disposed in the vicinity of the discharge outlet 11 and on the back side of an image receiving sheet 20 for receiving an ink droplet 95 discharged, respectively, and a acceleration control unit 17 for controlling an electric signal applied across these accelerative electrodes 143 and 144 is provided. In FIG. 6, the accelerative electrode 144 disposed on the back side of the image receiving sheet is arranged separately from the second bias electrode 142. However, it is also possible to use them as an integral body.

The process up to the discharge of the ink droplet from the discharge outlet 11 is same as in the first embodiment, and the second embodiment has a feature of controlling the ink droplet after the discharge.

A voltage is applied across the accelerative electrodes 143 and 144 by the acceleration control unit 17 in the direction accelerating the ink droplet. The ink droplet discharged is accelerated by an electric field formed between the accelerative electrodes 143 and 144, and accurately impacted on the image receiving sheet 20.

As described above, compared with conventional ink jet recording devices, good impact accuracy can be obtained by providing the accelerative electrodes 143 and 144, even when the space between the recording head 1 and the image receiving sheet 20 is increased.

A third embodiment of aspect B of the invention will be described with reference to FIGS. 9(*a*) and 9(*b*).

Figure 9A:
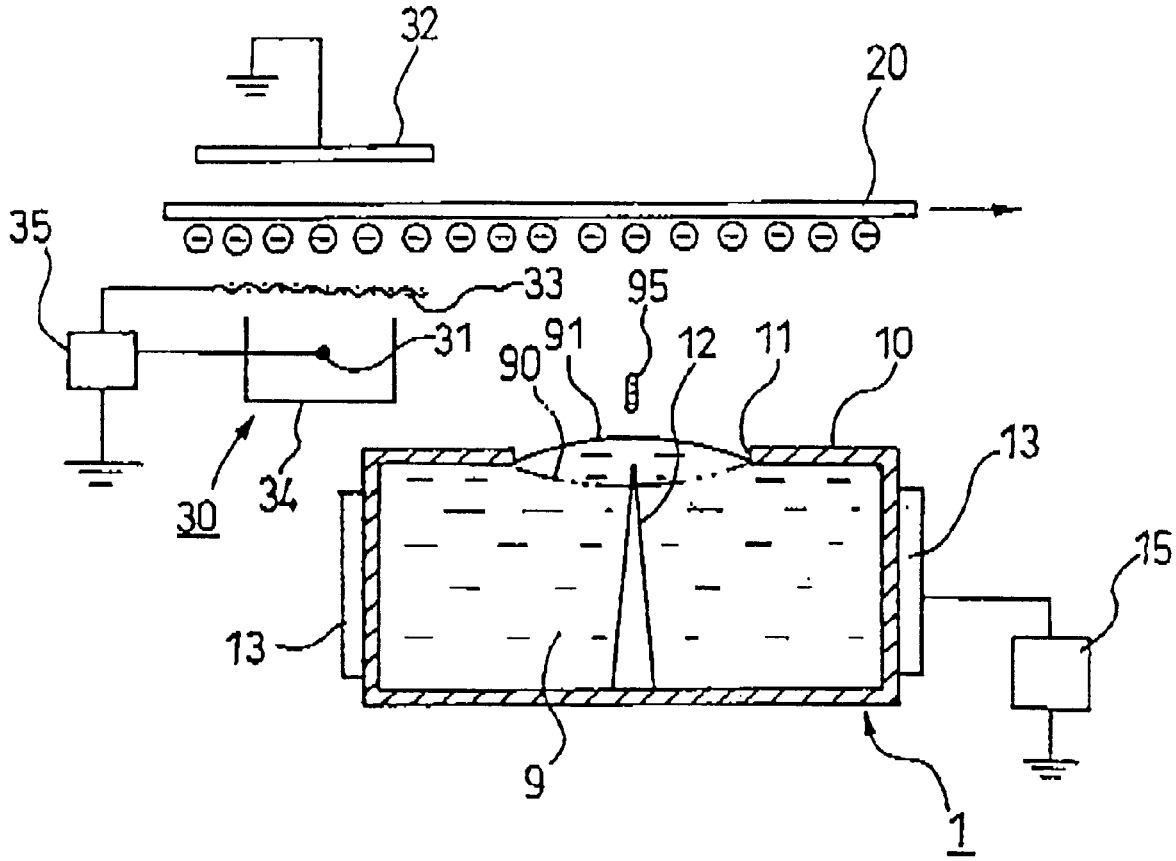
FIG. 9(*a*) is a schematic cross sectional view showing a third embodiment of aspect B of the invention, and FIG. 9(*b*) is a schematic plan view thereof.
Figure 9B:
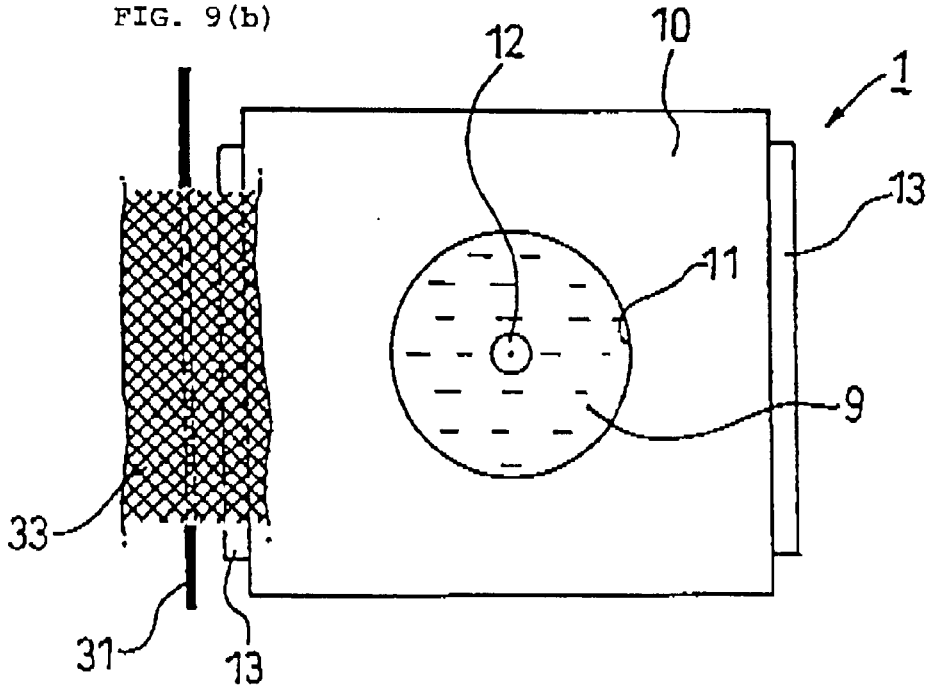

FIG. 9(*a*) is a schematic cross sectional view showing the third embodiment of aspect B of the invention, and FIG. 9(*b*) is a schematic plan view thereof. In the schematic plan view, a second electrode, an image receiving sheet, a charge control unit and a part of grid electrode are excluded for convenience' sake. Referring to FIGS. 9(*a*) and 9(*b*), similar to FIG. 4(*a*)-1, numeral 1 is a recording head, numeral 10 is an ink chamber, numeral 11 is a discharge outlet, numeral 12 is a projection, numeral 13 is an ink meniscus formation unit, Numeral 15 is a meniscus control unit, and numeral 9 is ink. The third embodiment of aspect B is different from the first embodiment in that a charge unit for charging the image receiving sheet 20 and a charge control unit for controlling the charge unit are provided. Numeral 30 is the charge unit, numeral 31 is a corona wire (first electrode), numeral 32 is a second electrode and numeral 33 is the grid electrode, which is provided, for example, in the form of mesh as shown in the plan view of FIG. 9(*b*). Numeral 34 is a case and numeral 35 is the charge control unit.

A scorotron corona charger that can provide uniform and stable charge is used as the charge unit 30. The scorotron corona charger 30 is a non-contact type charge device wherein a high voltage (e.g., about −6 kV) is applied to a thin corona wire (first electrode) 31 to generate corona discharge across the first electrode 31 and the second electrode 32, and the image receiving sheet 20 is exposed to the corona discharge emitted from the opening of the case 34 to charge. The grid electrode 33 is disposed between the corona wire 31 and the second electrode 32. The grid electrode 33 and the corona wire 31 are connected to the charge control unit 35, respectively.

The charge control unit 35 can independently control the voltage applied to the corona wire 31 and the voltage applied to the grid electrode 33, and selects each value of the voltages so that a charge amount is controlled so as to charge the image receiving sheet 20 in an amount corresponding to a bias voltage irrespective of the image data signal. Specifically, while the bias voltage control unit 16*c* applies the bias voltage irrespective of the image data signal in the first embodiment, in the third embodiment, the charge control unit 35 controls so as to charge the image receiving sheet 20 in an amount corresponding to the bias voltage irrespective of the image data signal.

When no ink droplet is discharged, the meniscus formation unit 13 is not operated. Accordingly, ink meniscus is not formed around a leading edge of the projection 12. At that time, since the image receiving sheet 20 is charged in an amount corresponding to the bias voltage irrespective of the image signal under control by means of the charge control unit 35, a strong electric field is formed around the leading edge of the projection 12 due to the charge. However, the strong electric field does not act to discharge the ink, because the leading edge of the projection protrudes outside the ink surface illustrated as numeral 90 in FIG. 9(*a*). Even when the amount of the charge is relatively high, undesirable ink discharge does not occur, since no ink meniscus is formed around the leading edge of the projection 12.

In case of discharging the ink droplet, the meniscus formation unit 13 is driven by an image signal from the meniscus control unit 15, and the ink 9 in the ink chamber 10 protrudes from the discharge outlet 11 as numeral 91 of FIG. 9(*a*) so that the leading edge of the projection goes down in the ink. When the ink meniscus is formed on the leading edge of the projection 12, the ink is attracted toward the image receiving sheet 20 with the strong electric field formed around the leading edge of the projection 12, and finally discharged as the minute ink droplet 95.

The ink droplet 95 thus discharged has a small size in comparison with an ink droplet discharged from a recording head without the projection so that it is possible to conduct recording of high image quality.

It is also possible to control the amount of the ink droplet 95 discharged by the pulse width of the pulse voltage from the meniscus control unit 15. The smaller opening diameter of the discharge outlet 11 is better from the viewpoint of meniscus formation, and the opening diameter may be appropriately determined depending on the ink 9 used and the ability of the meniscus formation unit 13. However, for inhibiting clogging, it is preferred that the opening diameter of the discharge outlet 11 is as large as possible within the meniscus formable range. According to the invention, the electric field can be concentrated at the leading edge of the projection 12 so that a considerably large opening diameter can form an ink meniscus.

As described above, the electric field can be concentrated at the leading edge of the projection 12 so that the opening of the discharge outlet can be considerably increased in size. Further, since the ink is discharged from the leading edge of the projection, even the use of ink having a high particle concentration compared with ink for use in conventional ink jet recording devices results in no clogging of the ink, and allows to discharge a minute ink droplet.

Since the ink having a high particle concentration and a low solvent concentration can be used without the occurrence of clogging in the discharge outlet, blur of image hardly occur. Further, images of high quality can be obtained because of rapid drying speed.

When resistance of the image receiving sheet 20 is low, it is preferred to dispose an insulating material between the image receiving sheet 20 and the second electrode 32. As the charge unit, any charger capable of controlling the charge amount including a corotron and a known solid charger, e.g., a roller charger may be preferably used in addition to the scorotron.

Although the charge unit 30 and the charge control unit 35 are arranged apart from the recording head 1 in the embodiment, they are positioned on the recording head 1 so that bases for attaching the units can be omitted and the device is made more compact.

Figure 10:
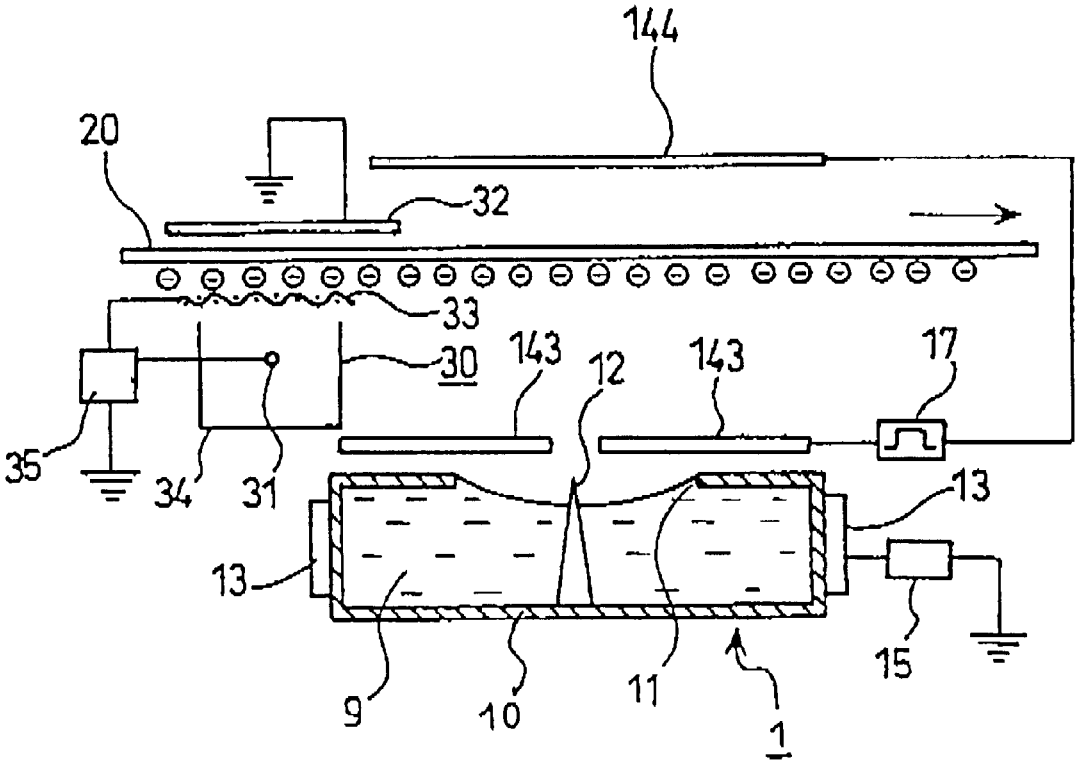
FIG. 10 is a schematic cross sectional view showing a fourth embodiment of aspect B of the invention.

To the recording device of FIG. 9(*a*), the second embodiment of the invention described above can also be applied FIG. 10 shows a fourth embodiment of aspect B of the invention in which the recording device of FIG. 9(*a*) is equipped with accelerative electrodes 143 and 144. In FIG. 10, numeral 1 is a recording head, numeral 10 is an ink chamber, numeral 11 is a discharge outlet, numeral 12 is a projection, and numeral 13 is an ink meniscus formation unit. Numeral 15 is a meniscus control unit, and numeral 9 is ink. Numeral 30 is a charge unit, numeral 31 is a corona wire (first electrode), numeral 32 is a second electrode, numeral 33 is a grid electrode, numeral 34 is a case and numeral 35 is a charge control unit.

In FIG. 10, the accelerative electrode 144 disposed on the back side of the image receiving sheet is arranged separately from the second electrode 32. However, it is also possible to use them as an integral body.

Since the process up to the discharge of the ink droplet from the discharge outlet 11 is same as in the third embodiment above, the description is omitted. The fourth embodiment has a feature of controlling the ink droplet after the discharge. The accelerative electrodes 143 and 144 are each disposed in the vicinity of the discharge outlet 11 and on the back side of the image receiving sheet 20 for receiving an ink droplet discharged, respectively, and an acceleration control unit 17 for controlling an electric signal applied across these accelerative electrodes 143 and 144 is provided.

A voltage is applied across the accelerative electrodes 143 and 144 by the acceleration control unit 17 in the direction accelerating the ink droplet. The ink droplet discharged is accelerated by an electric field formed between the accelerative electrodes 143 and 144, and accurately impacted on the image receiving sheet 20.

As described above, compared with the ink jet recording device in the third embodiment described above, good impact accuracy can be obtained by providing the accelerative electrodes 143 and 144, even when the space between the recording head 1 and the image receiving sheet 20 is increased.

According to aspect B of the invention, the recording head is provided with the ink chamber, the projection disposed at the approximately center portion in the ink chamber so that the leading edge thereof points toward the discharge outlet, the first bias electrode arranged in the vicinity of the projection, and the second bias electrode arranged on the back side of the image receiving sheet for receiving the ink droplet discharged. The bias voltage not based on the image data signal is applied across the bias electrodes, and the meniscus formation unit forms the meniscus around the leading edge of the projection by the image signal, thereby discharging the ink from the leading edge of the projection. It becomes therefore possible to use inexpensive and small-sized control units. Further, since the ink is discharged from the leading edge of the projection, minute droplets can be discharged, even when the discharge outlet is increased in size.

Moreover, even the application of ink having high concentration and high viscosity causes no clogging of the ink in the discharge outlet, because the discharge outlet increased in size can be used. It becomes therefore possible to provide the ink jet recording giving reduced blur, high drying speed, high image quality and good productivity.

In addition, according to the embodiment wherein the accelerative electrodes are each disposed in the vicinity of the discharge outlet and on the back side of the image receiving sheet, respectively, and the signal is applied across these accelerative electrodes. Thus, the ink droplet discharged is accelerated by the electric field formed between the accelerative electrodes so that the ink droplet is accurately impacted on the image receiving sheet, which makes possible the ink jet recording of high image quality.

Moreover, in case of using the charge of image recording sheet in place of the bias voltage, a load to the recording head can be decreased.

The entire disclosure of each and every foreign patent application from which the benefit of foreign priority has been claimed in the present application is incorporated herein by reference, as if fully set forth herein.

While the invention has been described in detail and with reference to specific examples thereof, it will be apparent to one skilled in the art that various changes and modifications can be made therein without departing from the spirit and sore thereof.

What is claimed is:

1. An ink jet recording method comprising discharging ink from a leading edge of a projection to form an image, in which (1) the ink is discharged by applying a voltage across electrodes based on an image data signal, and forming a meniscus around the leading edge of the projection in synchronism with the image data signal, or (2) the ink is discharged by forming a meniscus around the leading edge of the projection based on an image data signal in an electrostatic field.

2. An ink jet recording device discharging an ink droplet toward an image receiving sheet, which comprises an ink tank and a recording head communicating with the ink tank, wherein the recording head comprises an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first discharge electrode arranged in a vicinity of the projection, a second discharge electrode arranged on the back side of the image receiving sheet, a discharge control unit for controlling an electric signal applied across the first discharge electrode and the second discharge electrode, and a meniscus control unit for controlling the meniscus formation unit, wherein the discharge control unit controls the electric signal comprising a pulse voltage based on an image data signal and a bias voltage irrespective of the image data signal, and the meniscus control unit controls the meniscus formation unit in synchronism with the image data signal.

3. The ink jet recording device according to claim 2, wherein the meniscus formation unit is any one of a piezoelectric element, a heating element and an ultrasonic generating element, or a combination of two or more thereof.

4. The ink jet recording device according to claim 2, wherein the projection has a dielectric constant of 3 or more.

5. The ink jet recording device according to claim 2, wherein the ink tank is communicated with the ink chamber through a porous member.

6. The ink jet recording device according to claim 2, wherein the recording head further comprises a temperature detecting unit for detecting the temperature of the recording head, and a temperature control unit for heating and/or cooling the recording head in response to the temperature detected.

7. The ink jet recording device according to claim 2, which further comprises a first accelerative electrode provided in the vicinity of the recording head, and a second accelerative electrode provided on the back side of the image receiving sheet.

8. A recording head comprising an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first discharge electrode arranged in a vicinity of the projection, a discharge control unit for controlling an electric signal applied across a second discharge electrode provided on the back side of an image receiving sheet for receiving an ink droplet discharged and the first discharge electrode, and a meniscus control unit for controlling the meniscus formation unit, wherein the discharge control unit controls the electric signal comprising a pulse voltage based on an image data signal and a bias voltage irrespective of the image data signal, and the meniscus control unit controls the meniscus formation unit in synchronism with the image data signal.

9. An ink jet recording device discharging an ink droplet toward an image receiving sheet, which comprises an ink tank and a recording head communicating with the ink tank, wherein the recording head comprises an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first bias electrode arranged in a vicinity of the projection, a second bias electrode arranged on the back side of the image receiving sheet, a bias voltage control unit for controlling a bias voltage applied across the first bias electrode and the second bias electrode, and a meniscus control unit for controlling the meniscus formation unit, wherein the bias voltage control unit controls the bias voltage irrespective of an image data signal, and the meniscus control unit controls the meniscus formation unit based on the image data signal.

10. The ink jet recording device according to claim 9, wherein the meniscus formation unit is any one of a piezoelectric element, a heating element and an ultrasonic generating element, or a combination of two or more thereof.

11. The ink jet recording device according to claim 9, wherein the projection has a dielectric constant of 3 or more.

12. The ink jet recording device according to claim 9, wherein the ink tank is communicated with the ink chamber through a porous member.

13. The ink jet recording device according to claim 9, wherein the recording head further comprises a temperature detecting unit for detecting the temperature of the recording head, and a temperature control unit for heating and/or cooling the recording head in response to the temperature detected.

14. The ink jet recording device according to claim 9, which further comprises a first accelerative electrode provided in the vicinity of the recording head, and a second accelerative electrode provided on the back side of the image receiving sheet fixing member.

15. A recording head comprising an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first bias electrode arranged in a vicinity of the projection, a bias voltage control unit for controlling a bias voltage applied across a second bias electrode provided on the back side of an image receiving sheet for receiving an ink droplet discharged and the first bias electrode, and a meniscus control unit for controlling the meniscus formation unit, wherein the bias voltage control unit controls the bias voltage irrespective of an image data signal, and the meniscus control unit controls the meniscus formation unit based on the image data signal.

16. An ink jet recording device discharging an ink droplet toward an image receiving sheet, which comprises an ink tank and a recording head communicating with the ink tank, wherein the recording head comprises an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a first discharge electrode arranged in a vicinity of the projection, a second discharge electrode arranged on the back side of the image receiving sheet, a discharge control unit for controlling an electric signal applied across the first discharge electrode and the second discharge electrode, a meniscus control unit for controlling the meniscus formation unit, a charge unit for charging the image receiving sheet and a charge control unit for controlling a charge amount of the charge unit, wherein the discharge control unit controls a pulse voltage based on an image data signal, the charge control unit controls a charge amount on the image receiving sheet to an amount corresponding to a bias voltage irrespective of the image data signal, and the meniscus control unit controls the meniscus formation unit in synchronism with the image data signal.

17. A recording head comprising an ink chamber provided with a discharge outlet, an projection disposed at an approximately center portion in the ink chamber so that a leading edge thereof points toward the discharge outlet, a meniscus formation unit for forming an ink meniscus around the Leading edge of the projection disposed in the ink chamber, a first discharge electrode arranged in a vicinity of the projection, a discharge control unit for controlling an electric signal applied across a second discharge electrode provided on the back side of an image receiving sheet for receiving an ink droplet discharged and the first discharge electrode, and a meniscus control unit for controlling the meniscus formation unit, a charge unit for charging the image receiving sheet and a charge control unit for controlling a charge amount of the charge unit, wherein the discharge control unit controls a pulse voltage based on an image data signal, the charge control unit controls a charge amount on the image receiving sheet to an amount corresponding to a bias voltage irrespective of the image data signal, and the meniscus control unit controls the meniscus formation unit in synchronism with the image data signal.

18. An ink jet recording device discharging an ink droplet toward an image receiving sheet, which comprises an ink tank and a recording head communicating with the ink tank, wherein the recording head comprises an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a meniscus control unit for controlling the meniscus formation unit, a charge unit for charging the image receiving sheet and a charge control unit for controlling a charge amount of the charge unit, wherein the charge control unit controls a charge amount on the image receiving sheet to an amount corresponding to a bias voltage irrespective of the image data signal, and the meniscus control unit controls the meniscus formation unit based on the image data signal.

19. A recording head comprising an ink chamber provided with a discharge outlet, an projection disposed at an approximately center portion in the ink chamber so that a leading edge thereof points toward the discharge outlet, a meniscus formation unit for forming an ink meniscus around the leading edge of the projection disposed in the ink chamber, a meniscus control unit for controlling the meniscus formation unit, a charge unit for charging the image receiving sheet and a charge control unit for controlling a charge amount of the charge unit, wherein the charge control unit controls a charge amount on the image receiving sheet to an amount corresponding to a bias voltage irrespective of the image data signal, and the meniscus control unit controls the meniscus formation unit based on the image data signal.

* * * * *